US006223698B1

(12) United States Patent
Lacaze

(10) Patent No.: US 6,223,698 B1
(45) Date of Patent: May 1, 2001

(54) DEVICE FOR PRODUCING HOT WATER

(75) Inventor: Pierre Lacaze, Leyme (FR)

(73) Assignees: Institut Francais du Petrole, Rueil-Malmaison Cedex; Lacaze S.A., Leyme, both of (FR)

( * ) Notice: Subject to any disclaimer, the term of this patent is extended or adjusted under 35 U.S.C. 154(b) by 0 days.

(21) Appl. No.: 09/463,289

(22) PCT Filed: Jul. 21, 1998

(86) PCT No.: PCT/FR98/01594

§ 371 Date: Mar. 20, 2000

§ 102(e) Date: Mar. 20, 2000

(87) PCT Pub. No.: WO99/05461

PCT Pub. Date: Feb. 4, 1999

(30) Foreign Application Priority Data

Jul. 24, 1997 (FR) ..... 97 09550

(51) Int. Cl.[7] ..... F22B 1/26
(52) U.S. Cl. ..... 122/31.2; 122/18.3
(58) Field of Search ..... 122/13.01, 13.3, 122/17.1, 18.3, 31.2, 33, 51, 55

(56) References Cited

U.S. PATENT DOCUMENTS 4,530,347 * 7/1985 Baker et al. ..... 122/31.2
4,658,803 * 4/1987 Ball et al. ..... 122/31.2
5,086,731 * 2/1992 Lockett et al. ..... 122/31.2
5,799,620 * 9/1998 Cleer, Jr. et al. ..... 122/31.2

FOREIGN PATENT DOCUMENTS 387983 9/1990 (EP) .
2129916 5/1984 (GB) .

* cited by examiner

*Primary Examiner*—Gregory Wilson
(74) *Attorney, Agent, or Firm*—Antonelli, Terry, Stout & Kraus, LLP

(57) ABSTRACT

The invention concerns a device for producing hot water comprising at least one burner (13) arranged to produce rapid combustion inside the combustion chamber. The combustion chamber consists of a sealed container (14) delimiting an internal volume separated from the water so as to allow dry combustion. Said container (14) is immersed in a water section (12) and it is extended by at least one smoke gas diffuser (15) diffusing the smoke gases above the water section within a mass of water showered by spraying means (10). A layer of nodules (11) can be interposed on the path of the smoke gases and the sprayed water so as to increase the thermal exchange generated, by direct contact between the smoke gases and the water spray, and by conduction between container (14) and water section (12). The invention enables to achieve excellent thermal efficiency levels while producing smoke gases with a reduced CO ratio.

7 Claims, 4 Drawing Sheets

DEVICE FOR PRODUCING HOT WATER

FIELD OF THE INVENTION

The invention concerns a new device for producing hot water of the type comprising a burner, in particular a gas burner, sustaining rapid combustion in a combustion chamber.

BACKGROUND OF THE INVENTION

Conventional devices for producing hot water comprise a (generally tubular) exchanger wherein the water to be heated circulates in order to transfer calories through an exchange wall. The main drawback of these exchange circuit devices lies in the poor heat transfer efficiency level.

A new type of device for producing hot water, referred to as direct contact device, has appeared in the past ten years, wherein the water to be heated is sprayed and flows through the combustion chamber so that the exchange occurs directly without any interposed exchange wall; this type of direct contact device is characterized in that the combustion chamber is wide open so as to allow direct contact between the flame and the sprayed water. In this new type of device, a layer of transfer nodules is most often arranged on the path of the smoke gases in order to ensure more complete heat transfer. An excellent transfer efficiency is thus obtained, that can be illustrated by the outlet temperature of the smoke gases which exceeds the temperature of the hot water obtained by a few degrees only (of the order of 5 to 10° C.). External hot gases are sometimes recovered and used as an additional heat input.

These direct contact devices are described in particular in the following patents U.S. Pat. No. 4,275,708, U.S. Pat. No. 4,574,775, U.S. Pat. No. 5,293,861, EP-0,082,139. It can be noted that this recent hot water production technique by direct contact had already been proposed in a very ancient U.S. patent (U.S. Pat. No. 884,223 delivered on Apr. 7, 1908) which describes a gas ramp C arranged at the base of an open combustion chamber E above which the water to be heated trickles.

Direct contact devices such as those described for example in patents GB-2,129,916 and EP-0,387,983 allow to reach remarkable transfer efficiency levels but they have several drawbacks. The most serious one, which considerably limits the development thereof, lies in the very high carbon monoxide ratio observed in the smoke gases produced by this type of device. This ratio, generally of the order of 500 to 700 ppm, remains, in the best case, above 150 to 200 ppm, which exceeds the ratios authorized by most standards (housing: ratio below 100 ppm in France). Another drawback of these devices comes from the very high temperature of the walls delimiting the combustion chamber (temperature of the order of 800° to 900° close to that of the flame): these walls, situated in an air/sprayed water/steam atmosphere, undergo great corrosion stresses; they can be equipped with cooling circuits, but this considerably increases the complexity and the cost of the device.

SUMMARY OF THE INVENTION

The present invention proposes a new device for producing hot water that allows to reach the transfer efficiency levels of direct contact devices without presenting the drawbacks thereof.

The main objective of the invention is to reduce the CO ratio of the gases discharged by direct contact devices to values equal or similar to those of the gases discharged by conventional exchange circuit devices; ratios of the order of 20 to 40 ppm are obtained according to the invention. These ratios can be obtained essentially for the following reasons:

in the first place, in the device according to the invention, the combustion obtained is a dry combustion carried out in a dry atmosphere in the hearth-container, furthermore, this combustion is a complete combustion.

Dry combustion is obtained in the device of the invention by designing and by arranging the smoke gas diffuser as defined in claim 1, so as to strictly prevent any water inflow and any steam entry in the hearth-container. The water and the steam are forced back in the vicinity of the discharge ports of the diffuser by suitable overpressure of the diffuser and of the hearth-container. Furthermore, the position of the diffuser and of its ports creates, in the vicinity of said ports, an air-lift type network that eliminates the internal secondary circulations that tend to form at the gas outlet (a phenomenon referred to as slipstream), these secondary circulations producing an effect of suction of the damp atmosphere of the enclosure towards the combustion chamber.

Complete combustion is obtained in the device of the invention by collecting the smoke gases at the end of the hearth-container situated on the opposite side from the burner. These gases have thus stayed long enough in the hearth-container for the combustion to be complete. Furthermore, the upstream portion of the diffuser connecting the hearth-container to the diffusion portion extends this residence time and allows in some cases (propane gas burner notably) to complete the combustion before discharge of the smoke gases in the enclosure.

Another objective of the invention is to eliminate the drawbacks of direct contact devices due to the high-temperature corrosive atmosphere to which the walls of the combustion chambers are subjected in this type of device.

The device for producing hot water according to the invention therefore comprises an enclosure provided, in the upper part thereof, with smoke gas discharge means, a combustion chamber consisting of at least one sealed contained referred to as hearth-container, extending along a substantially horizontal axis and arranged in a water section situated in the lower part of the enclosure, a burner associated with each hearth-container and arranged at one end thereof to produce rapid combustion extending along the horizontal axis of said hearth-container over the length thereof, water spraying means, associated with cold water delivery means and arranged so as to shower water in the upper part of the enclosure, hot water extraction means situated in the lower part of the enclosure, said device being characterized in that:

each hearth-container is extended, at its end situated on the opposite side from the burner, by a smoke gas diffuser comprising an upstream portion connected to said end situated on the opposite side from the burner and a diffusion portion extending in the enclosure above the hearth-container according to a substantially horizontal axis, the diffusion portion of the diffuser comprises smoke gas discharge ports provided in the lower half of the section of said portion so as to allow to establish an overpressure inside the diffuser and the hearth-container and to prevent water and steam entry in order to obtain a dry complete combustion inside said hearth-container, water level control means being associated with the water section to ensure, in said section, such a water level H that the hearth-container(s) are immersed in the water of said section and that the diffusion portion of the smoke gas diffuser remains constantly above said water level.

In the device of the invention, the smoke gases are brought into direct contact, at the diffuser outlet, with the water showered into the enclosure, but the combustion is carried out in a confined space separated from the water and the steam. Heat transfer occurs, on the one hand, by direct contact between the water and the smoke gases, and on the other hand by conduction through the walls of the hearth-container to the water of the water section; said diffuser(s) can also form an exchange surface in their upstream part connected to the hearth-container(s). Experiments have shown that, under such conditions, it is possible to simultaneously obtain:

a remarkable transfer efficiency level, of the same order as that of the aforementioned direct contact devices, a reduced CO ratio in the smoke gases, of the same order as that of conventional exchange circuit devices (20 to 40 ppm).

Achieving such a CO ratio, much lower than that of known direct contact devices, can be explained by the fact that, in the device of the invention, the combustion that takes place is a dry combustion protected from water and steam, whereas it is performed in the presence of water and steam in known direct contact devices. Water is a combustion inhibitor, as it is well-known, and its presence leads to incomplete combustion producing carbon monoxide that is found in the smoke gases. It can be noted that, in some known devices, the flame is more or less protected from too direct a contact with the water (cap H in patent U.S. Pat. No. 884,223 or combustion chamber set back in FIG. 10 of patent U.S. Pat. No. 4,895,136), but the combustion is not protected from splashes of water and it is in any case carried out in a damp atmosphere and in the presence of steam. Said steam constitutes an inert gas that dilutes the combustible and combustive gases and reduces the probability of encounter between the reactive molecules, so that its presence contributes to making the combustion incomplete.

It can be underlined that, in the invention, the internal volume of the hearth-container(s) is under overpressure in relation to the enclosure of the device as the rapid combustion occurs in a confined space (closed space connected to the diffuser but not wide open as it is the case in known direct contact devices): the steam contained in the enclosure thus does not tend to enter the hearth-container(s).

Furthermore, in the device of the invention, the hearth-container(s) are immersed in the water section provided at the bottom of the enclosure, so that their temperature remains low (of the order of 100 to 120° C.); the walls of the hearth-container(s) are not subjected to severe corrosion stresses because, on the one hand, of their moderate temperature, and on the other hand of their environment (liquid water on the external face and dry atmosphere on the internal face).

The hearth-container advantageously has a cylindrical general shape of substantially horizontal axis, the upstream portion of the diffuser is ascending and the diffusion portion extends in the enclosure parallel to the axis of the hearth-container.

More precisely, the diffusion portion of the diffuser comprises, as a discharge port, at least one longitudinal slot in the lower half thereof.

The device can comprise a single hearth-container associated with a single burner and a single diffuser. It can also comprise a single hearth-container associated with several burners and a single diffuser or several diffusers. The device can also comprise several hearth-containers associated each with one or more burners and one or more diffusers.

According to a preferred embodiment, each burner is a nozzle-mixing type forced-air gas burner in which the air and the gas are fed separately into the burner nozzle so that the flame develops in the combustion chamber; said burner is secured outside the enclosure, its nozzle opening onto the inlet of the hearth-container in order to develop a combustion along the horizontal axis thereof Such a burner increases the overpressure inside the hearth-container and guarantees combustion in a dry atmosphere protected from any steam trace.

The burner, the hearth-container and the diffuser preferably constitute an assembly consisting of a single piece, mounted removably in an orifice of the enclosure wall.

The water level control means associated with the water section are of any well-known type. In particular, they can comprise solenoid valves mounted, on the one hand, on the cold water supply means and, on the other hand, on the hot water extraction means, and a water pressure detector arranged at the base of the water section for controlling said solenoid valves so as to adjust the supply and discharge rate in order to have a suitable adjustment of the water level in said water section.

Furthermore, as it is known in the art, at least one layer of heat transfer nodules is advantageously interposed between the water spraying means and the smoke gas diffuser(s). This or these layers of nodules provide an additional heat transfer downstream from the primary transfers mentioned above (exchange by direct water droplets/smoke gas contact; exchange by water/hearth-container and possibly diffuser conduction). The smoke gases are thus discharged at a very low temperature (smoke gas/hot water difference similar to that of known direct contact devices), which allows to increase the transfer efficiency even further.

If need be, the device for producing hot water according to the invention can recover, in some applications, the heat of available external fumes in order to reduce the consumption of combustible gas in the burner.

The device according to the invention therefore comprises at least one external fumes inlet opening into the enclosure, above water level H.

According to an embodiment of the invention, the device can comprise at least two layers of heat transfer nodules, the external fumes inlet opening into the enclosure between said layers.

BRIEF DESCRIPTION OF THE DRAWINGS

Other features and advantages of the invention will be clear from reading the description hereafter of three embodiments given by way of non limitative example, with reference to the accompanying drawings wherein.

DETAILED DESCRIPTION OF THE INVENTION

Figures 1, 2:
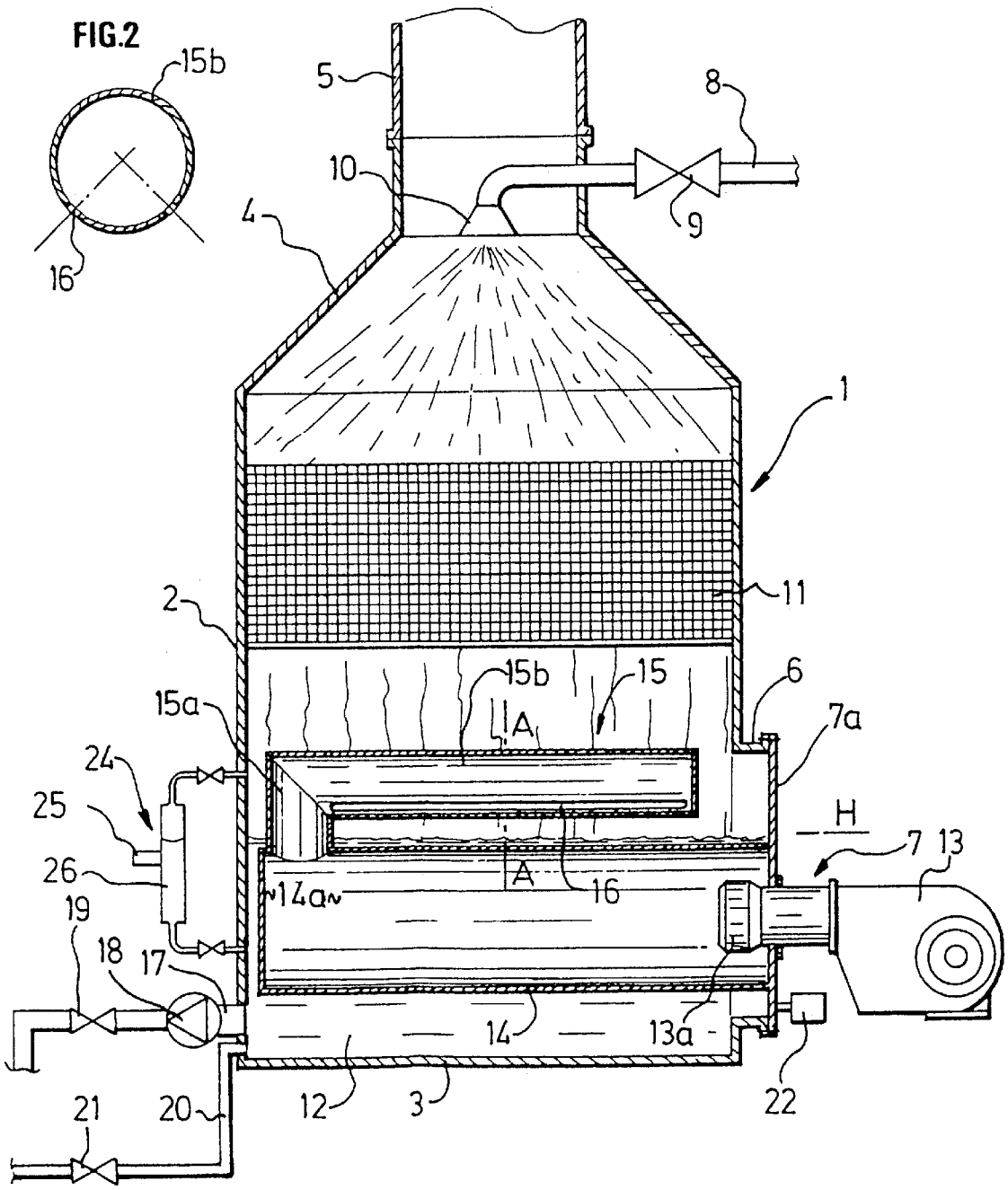
FIG. 1 is a section along a vertical plane of a first embodiment.
FIG. 2 is a detailed section of one of the elements along a plane AA.

The device for producing hot water shown by way of example in FIG. 1 comprises an enclosure 1 consisting of a heat-insulated tank, made up of a cylindrical wall 2 of vertical axis closed, in the lower part thereof, by a bottom wall 3 and, in the upper part, by a wall 4 converging upwards and topped by a fumes exhaust line 5.

The lower part of cylindrical wall 2 comprises an oval-shaped orifice on whose circumference a ring 6 provided with a flange allowing setting and fastening of a burner/hearth-container/diffuser assembly consisting of a single piece, bearing reference number 7 in FIGS. 1 and 2 and described hereafter, is welded (an assembly consisting of a single piece is understood to be an assembly that can come in form of a single piece, the various elements of this assembly can of course be dismounted and separated).

A cold water supply line 8 opens into the upper part of tank 1. A solenoid valve 9 is mounted on this line so as to allow supply rate adjustment.

Supply line 8 is bent so as to open into the tank along the vertical axis thereof in form of water spraying means 10 comprising a spray nozzle suited to shower the water over the whole section of the tank.

This water falls on a layer of nodules 11 of a well-known type, consisting for example of a plurality of stainless steel rings having a large surface of contact. The function of this layer is to provide complementary cooling of the gases resulting from the combustion and sizeable reheating of the water flowing therethrough.

The bottom of the tank forms a water section 12 whose level H is controlled by means detailed below.

Assembly 7 consisting of a single piece essentially comprises a burner 13 arranged to produce a combustion in a hearth-container 14 connected, on the opposite side from the burner, to a diffuser 15 that receives the smoke gases produced by the combustion.

This assembly 7 is provided with a front plate 7*a* whose shape is combined with that of flange ring 6 so as to allow the assembly to be removably fastened to tank 1.

Burner 13 is a nozzle-mixing type forced-air gas burner; it is secured outside tank 1 with its nozzle 13*a* opening into the inlet of hearth-container 14. The air and the combustible gas driven separately into said hearth-container perform a rapid combustion in said hearth-container of cylindrical general shape and substantially horizontal axis; the flame develops along the axis of said hearth-container over the length thereof.

Smoke gas diffuser 15 is connected by its ascending portion 15*a* to the end 14*a* of the hearth-container on the opposite side from the burner. This portion is continued, after a 90° bend, by a diffuser portion 15*b* extending above hearth-container 14.

In the example shown, connecting portion 15*a* is a very short section; if need be, it is possible to lengthen it so as to form a heat exchange wall immersed in the water section.

In the present embodiment, diffusion portion 15*b* is cylindrical (detailed FIG. 2) and extends substantially horizontally in tank 1. It comprises at least one smoke gas discharge slot such as 16 opening onto the lower half of the section of said portion 15*b*. In the example shown, two longitudinal slots extending along the portion are provided at an angle of 45° downwards in relation to the vertical mid-plane of the section. Of course, other types of opening can be provided, if need be, on the lower half of said section in order to prevent any water inflow in the diffuser. Protective lips can possibly be provided along the openings to increase the watertightness of the diffuser even further. These layouts, associated with the overpressure produced by the combustion and by the forced-air burner, provide in the hearth-container a dry atmosphere free of water and steam resulting from the ambience of tank 1.

In the lower part of water section 12, a main extraction line 17 provided with a pump 18 and a solenoid valve 19 provides normal discharge of the hot water during operation.

A secondary extraction line 20, provided with a solenoid valve 21 normally closed, is provided in parallel with the main line in order to allow, if need be, additional water discharge through opening of solenoid valve 21.

The main and secondary hot water extraction is controlled in connection with the cold water supply by conventional control means suited to adjust the water level H of section 12 to an intermediate level between hearth-container 14 and diffuser 15, so that said hearth-container 14 is always totally immersed in the water of section 12 and that diffusion portion 15*b* always remains out of the water.

Figure 3:
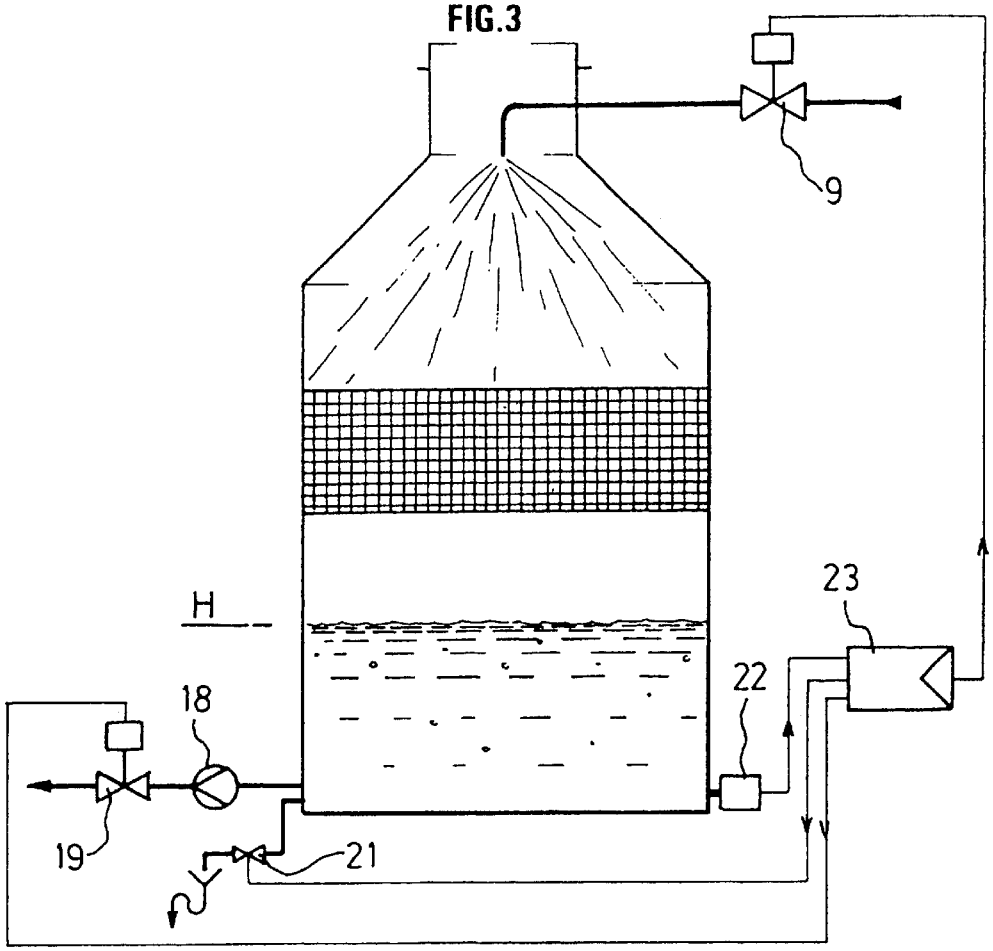
FIG. 3 is a diagram illustrating the water level control means.
Figure 4:
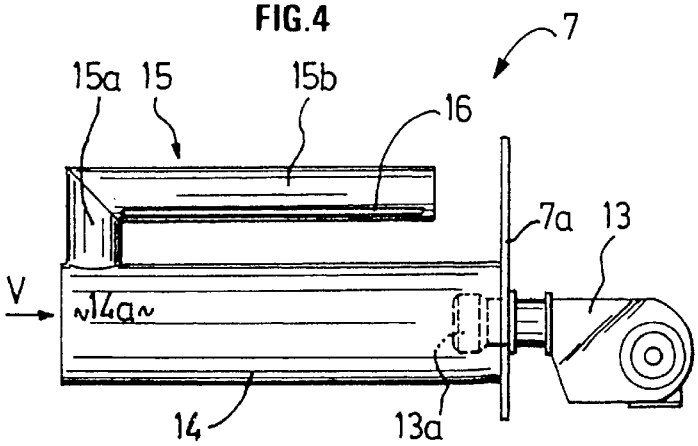
FIG. 4 is a diagrammatic view showing a subassembly of the device dismounted.
Figure 5:
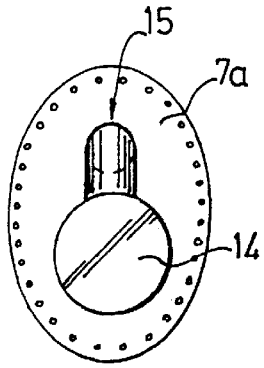
FIG. 5 is a front view of this subassembly in the direction shown by arrow V.

These control means comprise in this example, as shown in the figures and notably in FIG. 3, a water pressure detector 22 mounted at the base of the water section to deliver a signal representative of the water pressure and therefore of the water level of section 12, a programmable controller 23 receiving this signal and programmed to actuate solenoid valves 9, 19 and 21. During normal operation, the controller adjusts the supply rate through solenoid valve 19 so that these flow rates condition a water level H meeting the conditions defined above; in the steady state, these flow rates are equal, control being performed by suitable flow rate adjustments. If need be, solenoid valve 21 allows to perform an additional extraction in order to prevent a rise in the water level.

Furthermore, the device shown in the example is equipped with a safety system 24 that stops operation (cold water supply stop, burner stop) in case of lack of water, if the level of section 12 falls below a predetermined threshold. Accidental overheating of the walls of hearth-container 14 is thus prevented. System 24 conventionally comprises a capacitive detector 25 mounted on a by-pass line 26, a detector that controls stopping of burner 13 and closing of solenoid valve 9 in the absence of water at the level thereof.

The device according to the invention produces hot water by combining the following main advantages:

- a very high calorific output resulting from the complete nature of the combustion and remarkable heat transfer levels by conduction and direct contact (hearth-container wall/water, smoke gas/water droplets, smoke gas/water stream),
- a reduced CO ratio in the smoke gases as a result of the complete nature of the combustion in a dry atmosphere,
- low temperatures of the walls and notably of the walls of the hearth-container, which are the most exposed ones.

Figure 6:
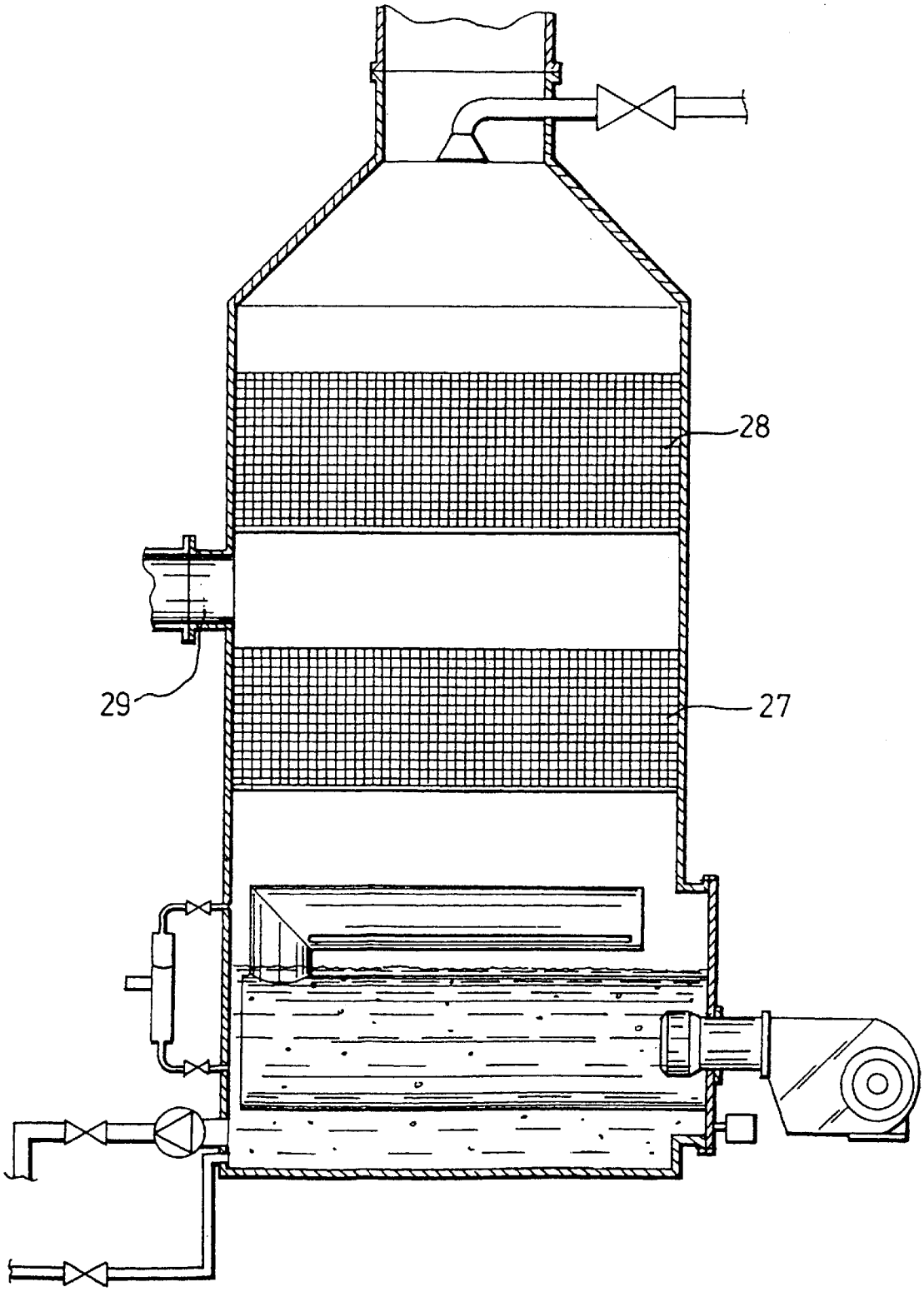
FIG. 6 is a vertical section of a second embodiment.

FIG. 6 illustrates another embodiment which differs from the first one in that it comprises two layers of nodules 27 and 28 situated on the path of the smoke gases above the diffuser.

These two layers are separated by a volume through which the water showers down. In this example, an external fumes inlet 29 opens into this volume between nodule layers 27 and 28 in order to recover heat from available fumes coming from another plant.

Without departing from the scope of the invention, one or more external fumes inlets can open onto one or more levels above water level H. The location of these branch connections will be selected according to the temperature level of the fumes and to the temperature gradient in the plant.

Figure 7:
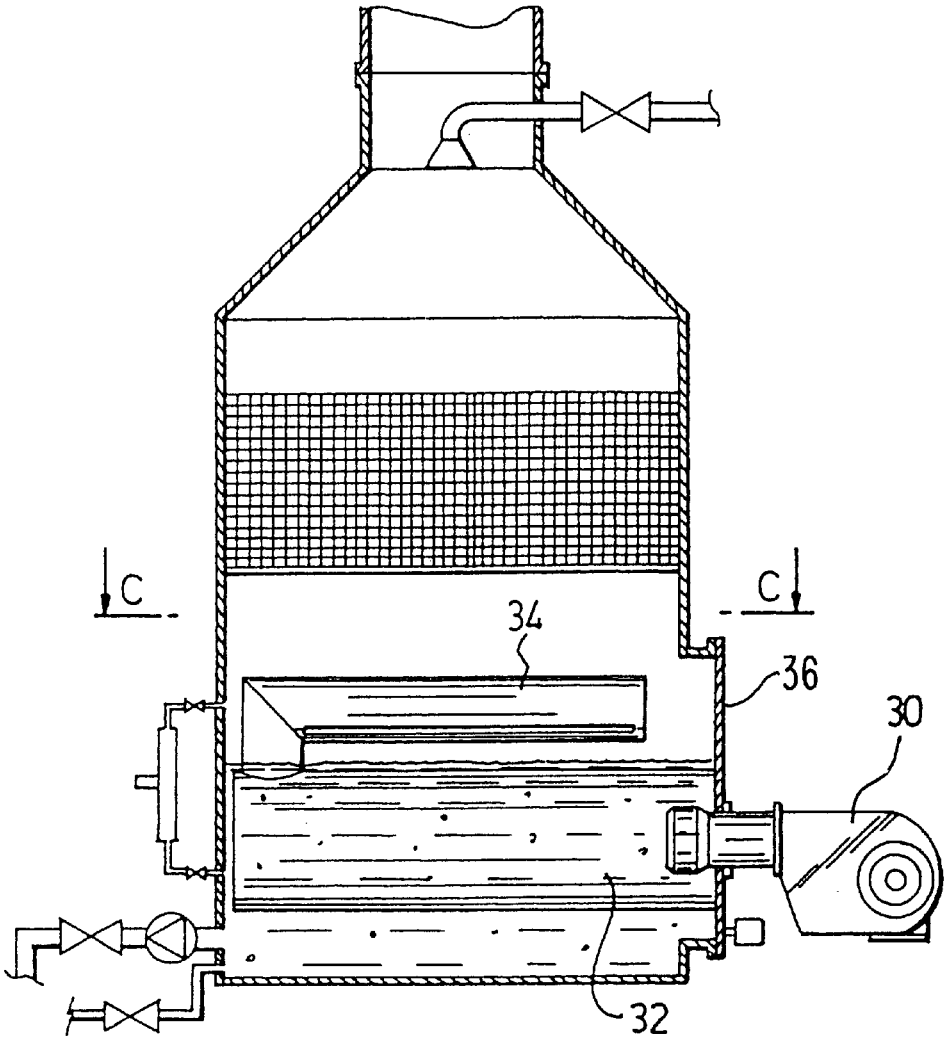
FIGS. 7 and 8 are diagrammatic views of a third embodiment, with a vertical section BB and a horizontal section along a plane CC respectively.
Figure 8:
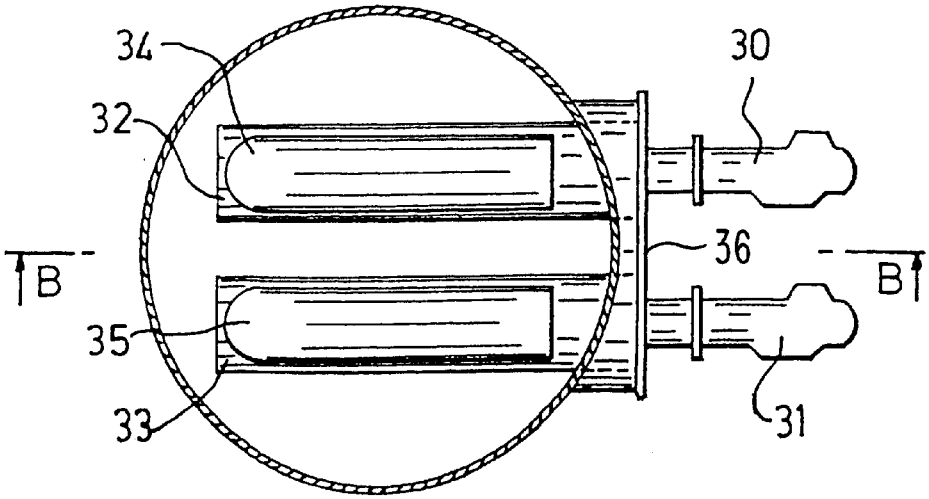

FIGS. 7 and 8 illustrate another embodiment wherein two burners 30 and 31 of the same type as burner 13 are provided. If need be, it is possible to provide a greater number of burners so as to reduce the power of each one for a plant having a given global power. In the example shown, each burner is associated with a hearth-container 32, 33 and with a diffuser 34, 35 placed above the corresponding hearth-container. Furthermore, the assembly consisting of burners 30, 31, hearth-containers 32, 33 and diffusers 34, 35 is made of a single piece and fastened as previously by means of a front wall 36 to the cylindrical wall of the tank.

What is claimed is:

1. A device for producing hot water, allowing to produce heat transfers by direct contact, with discharge of smoke gases with a reduced CO ratio, this device comprising an enclosure (1) provided, in the upper part thereof, with smoke gas discharge means (5), a combustion chamber consisting of at least one sealed container referred to as hearth-container (14), extending along a substantially horizontal axis and arranged in a water section (12) situated in the lower part of the enclosure, a burner (13) associated with each hearth-containing and arranged at one end thereof to produce a rapid combustion developing along the horizontal axis of said hearth-container over the length thereof, water spraying means (10) associated with cold water supply means (8) and arranged to shower water in the upper part of the enclosure, hot water extraction means (17–19) arranged in the lower part of the enclosure, said device being characterized in that:

each hearth-container is extended, at its end (14*a*) on the opposite side from the burner, by a smoke gas diffuser (15) comprising an upstream portion (15*a*) connected to said end on the opposite side from the burner and a diffusion portion (15*b*) extending in enclosure (1) above hearth-container (14) along a substantially horizontal axis, diffusion portion (15*b*) of the diffuser comprises smoke gas discharge ports (16) provided in the lower half of the section of said portion (15*b*) so as to allow to establish an overpressure inside the diffuser and the hearth-container and to prevent any water and steam entry in order to obtain a dry complete combustion inside said hearth-container, water level control means (9, 19, 21, 22 and 23) being associated with water section (12) in order to provide, in said section, such a water level H that the hearth-container(s) are immersed in the water of said section and that diffusion portion (15*b*) of the smoke gas diffuser remains constantly above said water level, wherein the control means comprise solenoid valves (9, 19, 21) mounted, on the one hand, on cold water supply means (8) and, on the other hand, on hot water extraction means (17, 20), and a water pressure detector (22) arranged at the base of water section (12) for controlling said solenoid valves in order to adjust the supply and extraction rates.

2. A device for producing hot water as claimed in claim 1, characterized in that hearth-container (14) has a cylindrical general shape of substantially horizontal axis, upstream portion (15*a*) of the diffuser is ascending and diffusion portion (15*b*) extends in enclosure (1) parallel to the axis of hearth-container (14).

3. A device for producing hot water as claimed in claim 2, characterized in that diffusion portion (15*b*) of the diffuser comprises as a discharge port at least one longitudinal slot (16) in the lower half thereof.

4. A device for producing hot water as claimed in claim 1, characterized in that each burner (13) is a nozzle-mixing type forced-air gas burner wherein the air and the gas are driven separately to the burner nozzle so that the flame develops in the combustion chamber, said burner being secured outside enclosure (1) with the nozzle opening into the inlet of hearth-container (14) to develop a combustion along the horizontal axis thereof.

5. A device as claimed in claim 4, wherein burner (13), hearth-container (14) and diffuser (15) form an assembly consisting of a single piece, mounted removably in an orifice of the wall of enclosure (1).

6. A device for producing hot water, allowing to produce heat transfers by direct contact, with discharge of smoke gases with a reduced CO ratio, this device comprising an enclosure (1) provided, in the upper part thereof, with smoke gas discharge means (5), a combustion chamber consisting of at least one sealed container referred to as hearth-container (14), extending along a substantially horizontal axis and arranged in a water section (12) situated in the lower part of the enclosure, a burner (13) associated with each hearth-containing and arranged at one end thereof to produce a rapid combustion developing along the horizontal axis of said hearth-container over the length thereof, water spraying means (10) associated with cold water supply means (8) and arranged to shower water in the upper part of the enclosure, hot water extraction means (17–19) arranged in the lower part of the enclosure, said device being characterized in that:

each hearth-container is extended, at its end (14*a*) on the opposite side from the burner, by a smoke gas diffuser (15) comprising an upstream portion (15*a*) connected to said end on the opposite side from the burner and a diffusion portion (15*b*) extending in enclosure (1) above hearth-container (14) along a substantially horizontal axis, diffusion portion (15*b*) of the diffuser comprises smoke gas discharge ports (16) provided in the lower half of the section of said portion (15*b*) so as to allow to establish an overpressure inside the diffuser and the hearth-container and to prevent any water and steam entry in order to obtain a dry complete combustion inside said hearth-container, water level control means (9, 19, 21, 22 and 23) being associated with water section (12) in order to provide, in said section, such a water level H that the hearth-container(s) are immersed in the water of said section and that diffusion portion (15*b*) of the smoke gas diffuser remains constantly above said water level, wherein at least one layer (11) of the heat transfer nodules is interposed between water spraying means (10) and smoke gas diffuser (15), and further comprising at least two layers (27, 28) of heat transfer nodules and an external fumes inlet (29) opening into enclosure (1) between said layers.

7. A device for producing hot water, allowing to produce heat transfers by direct contact, with discharge of smoke gases with a reduced CO ratio, this device comprising an enclosure (1) provided, in the upper part thereof, with smoke gas discharge means (5), a combustion chamber consisting of at least one sealed container referred to as hearth-container (14), extending along a substantially horizontal axis and arranged in a water section (12) situated in the lower part of the enclosure, a burner (13) associated with each hearth-containing and arranged at one end thereof to produce a rapid combustion developing along the horizontal axis of said hearth-container over the length thereof, water spraying means (10) associated with cold water supply means (8) and arranged to shower water in the upper part of the enclosure, hot water extraction means (17–19) arranged in the lower part of the enclosure, said device being characterized in that:

each hearth-container is extended, at its end (14*a*) on the opposite side from the burner, by a smoke gas diffuser (15) comprising an upstream portion (15*a*) connected to said end on the opposite side from the burner and a diffusion portion (15*b*) extending in enclosure (1) above hearth-container (14) along a substantially horizontal axis, diffusion portion (15*b*) of the diffuser comprises smoke gas discharge ports (16) provided in the lower half of the section of said portion (15*b*) so as to allow to establish an overpressure inside the diffuser and the hearth-container and to prevent any water and steam entry in order to obtain a dry complete combustion inside said hearth-container, water level control means (9, 19, 21, 22 and 23) being associated with water section (12) in order to provide, in said section, such a water level H that the hearth-container(s) are immersed in the water of said section and that diffusion portion (15*b*) of the smoke gas diffuser remains constantly above said water level, and further comprising at least one external fumes inlet opening into enclosure (1) above water level H.

* * * * *